US007829251B2

(12) United States Patent
Horgan et al.

(10) Patent No.: US 7,829,251 B2
(45) **Date of Patent: *Nov. 9, 2010**

(54) MECHANICAL AND ELECTRICAL ROBUST IMAGING MEMBER AND A PROCESS FOR PRODUCING SAME

(75) Inventors: Anthony M. Horgan, Pittsford, NY (US); Robert C. U. Yu, Webster, NY (US); Satchidanand Mishra, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 273 days.

This patent is subject to a terminal disclaimer.

(21) Appl. No.: 11/089,301

(22) Filed: Mar. 24, 2005

(65) Prior Publication Data

US 2006/0216618 A1 Sep. 28, 2006

(51) Int. Cl.
*G03G 5/047* (2006.01)

(52) U.S. Cl. ..... 430/57.3; 430/58.05; 430/58.35; 430/58.65; 430/58.7; 430/58.75; 430/58.8; 430/58.85

(58) Field of Classification Search ..... 430/57.3, 430/58.05, 58.35, 58.65, 58.7, 58.75, 58.8, 430/58.85
See application file for complete search history.

(56) References Cited

U.S. PATENT DOCUMENTS 3,121,006 A 2/1964 Middleton et al.
4,233,384 A 11/1980 Turner et al.
4,265,990 A 5/1981 Stolka et al.
4,286,033 A 8/1981 Neyhart et al.
4,291,110 A 9/1981 Lee
4,291,505 A 9/1981 Taniishi et al.
4,299,897 A 11/1981 Stolka et al.
4,306,008 A 12/1981 Pai et al.
4,338,387 A 7/1982 Hewitt
4,439,507 A 3/1984 Pan et al.
4,464,450 A 8/1984 Teuscher
4,587,189 A 5/1986 Hor et al.
4,664,995 A 5/1987 Horgan et al.
4,921,773 A 5/1990 Melnyk et al.
4,983,481 A 1/1991 Yu
5,089,369 A 2/1992 Yu
5,167,987 A 12/1992 Yu
5,240,532 A 8/1993 Yu
5,288,584 A * 2/1994 Yu ..... 430/128
5,422,213 A * 6/1995 Yu et al. ..... 430/60
5,606,396 A 2/1997 Yu et al.
5,729,878 A 3/1998 Kurihara et al.
5,885,512 A * 3/1999 Yu et al. ..... 264/512
5,911,934 A * 6/1999 Yu et al. ..... 264/237

(Continued)

OTHER PUBLICATIONS

U.S. Appl. No. 11/032,731, filed Jan. 10, 2005.*

*Primary Examiner*—Hoa V Le
(74) *Attorney, Agent, or Firm*—Fay Sharpe LLP

(57) ABSTRACT

Disclosed herein is a flexible imaging member having a high concentration of a charge transport compound having optimum enhanced mechanical and electrical characteristics. By increasing the concentration of the charge transport compound to a level of from about 55 weight percent or more, including from about 55 weight percent to about 70 weight percent, and from about 55 weight percent to about 65 weight percent, a flexible imaging member can be produced with reduced residual voltage and/or improved sensitivity. Furthermore, the fatigue cracking resistance of the charge transport layer can be improved through the implementation of a heat stress release process described more particularly herein.

8 Claims, 5 Drawing Sheets

U.S. PATENT DOCUMENTS 6,165,670 A * 12/2000 Yu et al. ..... 430/130
6,743,390 B2 6/2004 Yu et al.
7,182,903 B2 2/2007 Yu et al.
7,194,227 B2 3/2007 Yu
2003/0006709 A1 1/2003 Tabell
2003/0067097 A1 4/2003 Yu et al.
2003/0134210 A1 * 7/2003 Yu ..... 430/58.05
2005/0096431 A1 * 5/2005 Fujii et al. ..... 525/178
2005/0133965 A1 6/2005 Yu et al.
2006/0151922 A1 * 7/2006 Yu et al. ..... 264/482
2006/0216618 A1 9/2006 Horgan et al.

* cited by examiner

MECHANICAL AND ELECTRICAL ROBUST IMAGING MEMBER AND A PROCESS FOR PRODUCING SAME

BACKGROUND

Illustrated herein, in various embodiments, are a process and apparatus for producing a flexible, multi-layered electrostatographic imaging member having enhanced mechanical and electrical characteristics. In particular, this disclosure relates to a treatment process and processing apparatus for extending the service life of a flexible imaging member (and/or web stock thereof) having high concentrations of a charge transport compound.

Flexible electrostatographic imaging members are well known in the electrostatographic marking art. Typical flexible electrostatographic imaging members include, for example, (1) electrophotographic imaging members (photoreceptors) commonly utilized in electrophotographic (xerographic) processing systems and (2) electroreceptors, such as ionographic imaging members for electrographic imaging systems. The flexible electrostatographic imaging members can be in the form of seamless or seamed belts.

Typical electrophotographic imaging member belts comprise a dielectric imaging layer, or a charge transport layer and a charge generating layer, on one side of a supporting substrate layer. An optional anti-curl back coating can be applied to the opposite side of the supporting substrate layer to induce flatness.

The scope of embodiments disclosed herein covers an apparatus and process for effecting heat stress relief for a flexible electrostatographic imaging member having a high loading of a charge transport compound in the charge transport layer. Nonetheless, for reason of simplicity, the following descriptions will be focused generally on the web stock utilized to produce such flexible electrophotographic imaging members.

In this regard, electrophotographic flexible imaging members typically comprise a photoconductive layer, which can include a single layer or a composite of layers. As mentioned above, typical electrophotographic imaging members can exhibit undesirable upward imaging member curling. Consequently, an optional anti-curl back coating can be applied to each imaging member to produce a desired flatness.

One type of composite photoconductive layer used in electrophotography has at least two electrically operative layers. This is illustrated in U.S. Pat. No. 4,265,990, for example, the disclosure of which is hereby incorporated by reference. One layer comprises a photoconductive layer that can generate holes and inject the holes into a contiguous charge transport layer. Generally, where the two electrically operative layers are supported on a conductive layer with the photoconductive layer sandwiched between the contiguous charge transport layer and the conductive layer, the outer surface of the charge transport layer is normally charged with a uniform charge of a negative polarity and the supporting electrode is utilized as an anode. The supporting electrode can still function as an anode when the charge transport layer is sandwiched between the supporting electrode and the photoconductive layer. The charge transport layer in this case must be able to support the injection of photogenerated electrons from the photoconductive layer and to transport the electrons through the charge transport layer. Photosensitive members having at least two electrically operative layers can provide excellent electrostatic latent images when charged with a uniform negative electrostatic charge, exposed to a light image. The latent image is thereafter developed with finely divided electroscopic marking particles, such as toner particles, to form a toner image. The resulting toner image is usually transferred to a suitable receiving member, such as a paper substrate, for fusing, etc.

As more advanced, higher speed electrophotographic copiers, duplicators and printers have been developed, degradation of image quality has been encountered during extended cycling. Moreover, complex, highly sophisticated duplicating and printing systems operating at very high speeds have created stringent requirements including narrow operating limits on photoreceptors. For flexible electrophotographic imaging members having a belt configuration, the numerous layers found in modern photoconductive imaging members must be highly flexible, adhere well to adjacent layers, and exhibit predictable electrical characteristics within narrow operating limits to provide excellent toner images over many thousands of cycles.

One type of multilayered photoreceptor belt that has been employed as a belt in negatively charging electrophotographic imaging systems comprises a substrate, a conductive layer, an optional blocking layer, an optional adhesive layer, a charge generating layer, a charge transport layer, and a conductive ground strip layer adjacent to one edge of the imaging layers. This photoreceptor belt can also comprise additional layers, such as an anticurl back coating to balance curl and provide the desired belt flatness.

Moreover, in a machine service environment, the flexible multilayered photoreceptor belt is mounted on a belt supporting module that includes a number of support rollers. The belt is generally exposed to repetitive electrophotographic image cycling. This cycling subjects the outer-most charge transport layer to mechanical fatigue as the imaging member belt bends and flexes over the belt drive roller and all other belt module support rollers. The outer-most layer also experiences bending strain as the backside of the belt makes sliding and/or bending contact above each backer bar's curving surface. This repetitive action of belt cycling leads to a gradual deterioration in the physical/mechanical integrity of the exposed outer charge transport layer, leading to premature onset of fatigue charge transport layer cracking. The cracks developed in the charge transport layer as a result of dynamic belt fatiguing are found to manifest themselves into copy print defects, which thereby adversely affect the image quality on the receiving paper. In essence, the appearance of charge transport cracking cuts short the imaging member belt's intended functional service life.

When a production web stock, consisting of several thousand feet of coated multilayered electrophotographic imaging member, is obtained after finishing the charge transport layer coating/drying process, upward edge curling can occur. As a result, an anti-curl back coating is typically applied to the backside of the substrate support, opposite to the side having the charge transport layer, to counteract the curl and provide the imaging member web stock with desirable flatness. The exhibition of upward imaging member curling after completion of charge transport layer coating results from a thermal contraction mismatch between the applied charge transport layer and the substrate support. This occurs during heating/drying of the wet coating at elevated temperatures and the eventual cooling down to room ambient temperature.

As a result of the above-noted coating process, the charge transport layer in a typical flexible electrophotographic imaging member has a coefficient of thermal contraction approximately 2 to 5 times larger than that of the substrate support. Therefore, upon cooling to room ambient temperature, greater dimensional contraction occurs in the charge transport layer than in the substrate support. This causes the imaging member to spontaneously exhibit upward web stock curling and requires an anti-curl back coating to balance the curl and render flatness.

Consequently, in a typical flexible electrophotographic imaging member belt, it is frequently necessary to apply an anti-curl back coating to complete the imaging member web stock material package and provide desirable flatness. Nonetheless, the application of the anti-curl back coating onto the backside of the substrate support (for counter-acting the upward curling and render web stock flatness) causes the charge transport layer to build-in an internal tension strain of from about 0.15% to about 0.35% in its resulting coating layer material matrix. After converting the production web stock into flexible seamed imaging member belts, the internal strain built-in in the charge transport layer in each flexible belt is then cumulatively added to the bending induced strain that is produced as the belt flexes/bends repeatedly over a variety of belt module support rollers during dynamic imaging member belt cyclic functioning in a machine. The consequence of this cumulative strain generated in the charge transport layer has been found to cause promotion of early development of belt fatigue charge transport layer cracking problems.

Moreover, the cumulative charge transport layer strain has also been identified as the origin of the formation of bands of charge transport layer cracking when the imaging member belt is parked over the belt support module during periods of machine idling or overnight and weekend shut-off time, as the belt is under constant airborne chemical vapor and contaminants exposure. The bands of charge transport layer cracking are formed at the sites corresponding to the segments of belt bending over each of the belt supporting rollers. The crack intensity is also seen to be most pronounced for the band corresponding to the belt segment which is bent and parked directly over the smallest roller; this is due to the fact of material mechanics indicating that the smaller the roller diameter the belt segment is bent over, the greater is the bending strain is induced at the top surface of the outermost charge transport layer.

Accordingly, there is a need for a method of fabrication of improved flexible seamed electrophotographic imaging member belts, having a charge transport layer with little or no built-in internal tension to produce reduced bending strain under a normal dynamic imaging member belt machine service environment and also under the condition of static bent belt parking over the belt module support rollers during the time intervals of machine idling and extended periods of shut-off. Such improved imaging member belts will provide mechanical functioning life enhancement and effect the suppression of premature onset of charge transport layer cracking problem as well.

Conventional multi-layer flexible imaging member web stocks and methods for treating such members are disclosed in: U.S. Pat. Nos. 6,743,390; 6,165,670; 5,606,396; 5,240,532; 5,167,987; 5,089,369; and 4,983,481; and furthermore, U.S. Patent Publication No. 2003/0067097; U.S. patent application Ser. No. 10/385,409; and U.S. patent application Ser. No. 11/032,731. The disclosures of all of these are hereby incorporated by reference, represent prior efforts toward alleviating the problems discussed above. These efforts have been successful to a point; however, resolution of one problem has often been found to create a new one.

Additionally, a need exists to improve the service life of flexible imaging members having high loading levels of a charge transport compound. It has been found that increasing the loading levels of the charge transport compound to about 55 weight percent or more, such as from about 55 weight percent to about 65 weight percent, in the charge transport layer reduces residual voltage (Vr) and may also improve photo discharge sensitivity. However, increasing the charge transport compound content in the charge transport layer also makes the charge transport layer brittle and reduces its fatigue cracking resistance.

Therefore, there is a continued need to improve the methodology for cost effective production of flexible imaging members, particularly those exhibiting high contents of a charge transport compound.

BRIEF DESCRIPTION

The present disclosure relates, in various embodiments, to a process for fabricating electrophotographic imaging member web stock having high concentrations of a charge transport compound for producing a flexible multilayered electrophotographic imaging member that overcomes one or more of the above noted deficiencies. The concentration of the charge transport compound in the charge transport layer of the imaging member and/or web stock is from about 55 weight percent or more, including from about 55 weight percent to 70 weight percent, and from about 55 weight percent to about 65 weight percent.

In this regard, since the charge transport layer is the outermost top exposed layer, a seamed imaging member belt converted from the prepared flexible web stock is constantly subjected to fatigue bending strain as the belt flexes over each belt support module roller during electrophotographic imaging process. The repetitive action of fatigue tensioning the charge transport layer by each of the bending flexes facilitates the pulling of the polymer chains to cause eventual polymer chains separation seen as charge transport layer cracking; all cracks are oriented in the direction perpendicular to the belt direction.

Moreover, the addition of charge transport compound (which is small organic molecule) into the charge transport layer polymer matrix to effect crucial photo-electrical charge transporting function also dilutes the numbers of polymer chains present in per unit volume. As a consequence, the presence of charge transport compound weakens the mechanical property of the formulated charge transport layer and exacerbates the exhibition of pre-mature onset of charge transport cracking caused by fatigue imaging member belt bending flexes. To resolve the cracking issue and extend the service life of the belt, imaging member web stock is treated through a heat stress relieving process carried out over a curvature. This process has been demonstrated to provide significant reduction/minimization or even elimination the charge transport layer bending strain to thereby render the resulting charge transport an effectual resistance to develop early onset of bending induced fatigue cracking as the imaging member belt cyclic flexes over the belt support module rollers under normal machine operation conditions.

Another embodiment of the disclosure relates to a processing apparatus for providing heat stress relief to the web stock having a high concentration of a charge transport compound. Additionally, a further embodiment concerns a refined methodology for processing flexible multilayered electrophotographic imaging member web stock having a high concentration of a charge transport compound to produce a charge transport layer exhibiting reduced internal strain and free of ripple formation. The flexible imaging member so produced also exhibits improved photoelectrical properties, such as reduced residual potential, and enhanced crack resistance.

A still additional embodiment relates to a stress relief, flexible imaging member having a high loading content of a charge transport compound. The stress relief, flexible imaging member is produced according to the heat treatment process disclosed below.

Another embodiment is directed to a flexible imaging member having a high concentration of a charge transport compound in its charge transport layer. The imaging member has enhanced physical and electrical properties such as a reduced residual voltage of (Vr) of 20 or less and an improved cracking life of 40,000 cycles or more flexing over a 19 mm diameter belt module support roller.

Advantageously, a further embodiment relates to an enhanced and refined methodology for processing flexible multilayered electrophotographic imaging member web stock having a high concentration of a charge transport compound to reduce the charge transport layer bending strain that is induced when the imaging member belt flexes or is parking over belt support rollers. This results, in part, in a suppression of charge transport layer cracking, thereby extending the mechanical service life of the imaging member, as well as a reduction of copy printout defects caused by the development of ripples during manufacturing of the web stock. The imaging member also produces effectual residual voltage reduction and/or improved photo discharge sensitivity as well.

An improved web stock having high loading levels of a charge transport compound and treatment process for producing a flexible multilayered electrophotographic imaging member with enhanced properties is also included in the embodiments disclosed herein. Such a web stock has a charge transport layer having a high concentration of a charge transport compound. The web stock, when treated, exhibits a reduction or elimination of internal tension strain to provide effectual suppression of the early onset charge transport layer cracking. This imaging member web stock is particularly effective in minimizing charge transport layer cracking, which has been found to be caused by: (a) dynamic belt fatigue cyclic motion during machine imaging function; and/or (b) by exposure to environmental volatile organic chemical (VOC) species/contaminants during periods of belt parking over the belt support module rollers at the time when machine is idling or during periods of prolonged equipment shut-off. Additionally, this improved imaging member also produces less copy streak printout defects associated with the development of ripples during the manufacturing.

The embodiments disclosed herein also are directed to an improved heat treatment process with processing apparatus refinement for manufacturing a multilayered flexible electrophotographic imaging member web stock having a high concentration of a charge transport compound. The treatment process produces a reduction in charge transport layer internal strain and effects the resolution of ripple formation difficulties associated with conventional treatment processes. These embodiments also provide an added benefit of eliminating, in certain instances, the need of an anti-curl back coating from the imaging member since the treated web stock is nearly curl-free.

The present disclosure also relates to an improved stress-relieving process and processing apparatus which have a heat treatment processing feature which overcomes the shortfalls noted above. The apparatus has been successfully demonstrated and adopted for producing imaging member web stock having a high concentration of a charge transport compound. In essence, in the process, the imaging member web stock having a high concentration of a charge transport compound is transported and directed, with the transport layer facing outwardly, toward the surface of a circular metallic heat treatment tube to make contact with the surface of the heat treatment tube and instantaneously heat the transport layer surface of the contacted segment of the web stock up to an instant temperature elevation above the glass transition temperature (Tg) of the charge transport layer, then cooling the web stock down quickly to a temperature below the Tg just before the web stock leaves the heat treatment tube. This process imparts charge transport layer stress relief.

In a further embodiment, the heat treatment tube is designed to have a concave outer circumference which, according to the principles of web transport mechanics, enables the spontaneous creation of a transverse stretching force as the web stock travels over the treatment tube during heat stress relief processing. The created transversal web stock stretching force counteracts or neutralizes the ripples causing transversal web stock compression force. Consequently, the concave heat treatment tube design resolves the difficulties of the web stock ripple formation problem conventionally seen. The selected heat treatment tube design, as disclosed, for impacting effectual imaging member web stock stress relief processing is required to have specific physical attributes that are capable of generating/creating the traverse web stock stretching needed to accomplish the intended purpose.

Alternatively, an embodiment of the stress relief process of the present disclosure may also be enhanced by adding a selected concave roller positioned at the vicinity either immediately before or after the concave heat treatment tube to produce additional web stock stretching result. In this manner, the micro-ripples induced in the web stock will be further stretched out and eliminated by the created transversal tension force.

For achieving further electrophotographic imaging member treatment web stock ripple elimination, other embodiments of this disclosure may further include placing a selected concave roller right before and another selected concave roller (or an alternative spreader roller) immediately after the concave heat treatment tube to maximize imaging member transversal web stock stretching result.

The stress relief treated flexible electrophotographic imaging member web stock produced herein is then converted into seamed flexible belts. These belts generally comprise a flexible supporting substrate having an electrically conductive surface layer, an optional hole blocking layer, an optional adhesive layer, a charge generating layer, a charge transport layer having a high concentration of a charge transport compound, a ground strip layer, and may or may not need an anti-curl back coating. The flexible substrate support layer should be transparent, and can have a thickness of between about 25 μm and about 200 μm. A thickness in the range of from about 50 μm to about 125 μm gives better light transmission and substrate support layer flexibility. The conductive surface layer coated over the flexible substrate support can comprise any suitable electrically conductive material such as, for example, aluminum, titanium, nickel, chromium, copper, brass, stainless steel, silver, carbon black, graphite, and the like. The electrically conductive surface layer coated above the flexible substrate support layer may vary in thickness over a substantially wide range depending on the desired usage of the electrophotographic imaging member. However, from flexibility and partial light energy transmission considerations, the thickness of the conductive surface layer may be in a range from about 20 Å to about 750 Å. It is, nonetheless, desirable that the conductive surface layer coated over the flexible substrate support layer be between about 50 Å and 120 Å in thickness to provide sufficient light energy transmission of at least 20% transmittance to allow effective imaging member belt back erase.

In a still further embodiment, the present disclosure also provides an improved stress/strain relief process for producing a flexible, multilayered imaging member web stock having a high concentration of a charge transport compound comprising:

providing a multilayered imaging member web stock having a high concentration of a charge transport compound and including at least one layer to be treated, the at least one layer to be treated having a coefficient of thermal expansion significantly differing from a coefficient of thermal expansion of another layer;

passing the multilayered web stock over and making contact with a circular treatment tube having an outer concave arcuate circumferential surface that spontaneously creates a transverse web stock stretching force to offset the ripple causing transversal compression force in the at least one layer to be treated;

heating at least one layer to be treated instantaneously to above the glass transition temperature (Tg) of the at least one layer to be treated to thereby create a heated portion of the at least one layer to be treated, a portion of the web stock in proximity to the heated portion of the at least one layer to be treated thereby becoming a heated portion of the web stock;

inducing curvature conformance to the contacting concave circular surface of the treatment tube in the heated portion of the web stock; and cooling the heated portion of the web stock quickly below the glass transition temperature (Tg) at said curvature.

In another embodiment, the present disclosure provides an improved stress/strain relief process for a flexible, multilayered web stock having a high concentration of a charge transport compound including:

providing a multilayered web stock having a high concentration of a charge transport compound and including at least one layer to be treated, the at least one layer to be treated having a coefficient of thermal expansion significantly differing from a coefficient of thermal expansion of the other layers;

providing a processing treatment tube having an outer concave arcuate circumferential surface; passing the multilayered web stock over and in contact with the processing treatment tube to spontaneously create transversal stretching in the at least one layer to be treated;

providing a heat source over the processing treatment tube directly at the web stock portion entering and making contact with the tube;

heating the web stock portion substantially instantaneously to above the Tg of the at least one layer to be treated; and, cooling the web stock portion quickly below the Tg subsequently to heating.

These and other non-limiting aspects of the development are more particularly disclosed below.

BRIEF DESCRIPTION OF THE DRAWINGS

Various aspects of the present disclosure are described in more detail below with reference to the illustrations that represent exemplary embodiments. A more complete understanding of the disclosed heat stress relief treatment process and apparatus for producing a mechanical and electrical robust flexible imaging member having a high content of a charge transport compound can be obtained through understanding the descriptions of the accompanying figures wherein.

DETAILED DESCRIPTION

Figure 1:
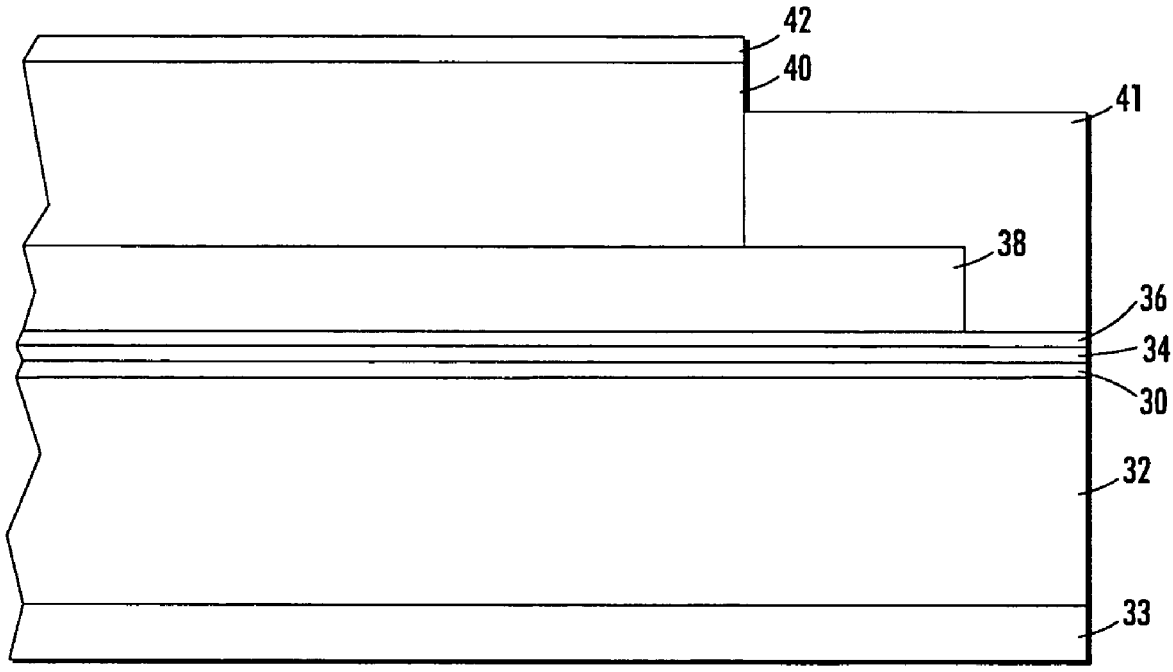
FIG. 1 illustrates a schematic partial cross-sectional view of a multiple layered flexible electrophotographic imaging member as seen along the width of the multi-layer member web stock.

Disclosed herein is a flexible imaging member having a high concentration of a charge transport compound having enhanced mechanical and electrical characteristics. By increasing the concentration of the charge transport compound to a level of from about 55 weight percent or more, including from about 55 weight percent to about 70 weight percent, and from about 55 weight percent to about 65 weight percent, a flexible imaging member can be produced with reduced residual voltage and/or improved sensitivity. Furthermore, the fatigue cracking resistance can be improved through the implementation of a heat stress release process described more particularly below.

For achieving a better understanding of the present innovative disclosure, reference is made to all these figures. In the figures, like reference numerals have been used throughout to designate identical elements or components.

For the sake of convenience, the embodiments of the disclosure will only be described hereinafter for electrophotographic imaging members in flexible belt form even though this disclosure is equally applicable for flexible electrographic imaging members of different materials designs as well. Although specific terms are used in the following description for the sake of clarity, these terms are intended to refer only to the particular structure of the disclosure selected for illustration in the figures, and are not intended to define or limit the scope of the embodiments.

A negatively charged, multilayered electrophotographic imaging member of flexible web stock configuration is illustrated in FIG. 1. Generally, such a member includes a substrate support layer 32 on which a conductive layer 30, a hole blocking layer 34, a charge generating layer 38, and an active charge transport layer 40 are formed. An optional adhesive layer 36 can be applied to the hole blocking layer 34 before the photogenerating layer 38 is deposited. Other layers, such as a grounding strip layer 41 or an overcoat layer 42 can be applied to provide various characteristics, such as improve resistance to abrasion. On the opposite surface of substrate support 32, an anticurl backing layer 33 can be applied to reduce the curling induced by the different coefficients of thermal expansion of the various layers of the belt.

Belts prepared from the imaging member web stock of the type shown in FIG. 1 are generally well known in the art, as are materials appropriate for their formation. Examples of electrophotographic imaging members having at least two electrically operative layers, including a charge generator layer and diamine containing transport layer, are disclosed in U.S. Pat. Nos. 4,265,990; 4,233,384; 4,306,008; 4,299,897;

and, 4,439,507, and U.S. Patent Publication No. 2003/0067097, the disclosures thereof being incorporated herein in their entirety.

The thickness of the substrate support 32 can depend on factors including mechanical strength, flexibility, and economical considerations, and can have, for example, a thickness of between about 25 μm and 200 μm. However, a thickness in the range of from about 50 μm to about 125 μm gives better light transmission and substrate support layer flexibility. A typical thickness of about 76 μm is generally accepted for use, since it presents best physical and mechanical effects on the prepared electrophotographic imaging member device. The substrate support 32 should not soluble in any of the solvents used in each coating layer solution, optically clear, and being thermally stable enable to stand up to a high temperature of about 150° C. A typical substrate support 32 used for conventional imaging member fabrication has a thermal contraction coefficient ranging from about $1\times10^{-5}$/° C. to about $3\times10^{-5}$/° C. and with a Young's Modulus of between about $5\times10^{5}$ psi and about $7\times10^{5}$ psi. However, materials with other characteristics can be used as appropriate.

The conductive layer 30 can vary in thickness over substantially wide ranges depending on the optical transparency and flexibility desired for the electrophotographic imaging member. Accordingly, when a flexible electrophotographic imaging belt is desired, the thickness of the conductive layer can be between about 20 Å and about 750 Å, and more preferably between about 50 Å and about 200 Å for an optimum combination of electrical conductivity, flexibility and light transmission. The conductive layer 30 can be an electrically conductive metal layer formed, for example, on the substrate by any suitable coating technique. Alternatively, the entire substrate can be an electrically conductive metal, the outer surface thereof performing the function of an electrically conductive layer and a separate electrical conductive layer may be omitted.

After formation of an electrically conductive surface, the hole blocking layer 34 can be applied thereto. The blocking layer 34 can comprise nitrogen containing siloxanes or nitrogen containing titanium compounds as disclosed, for example, in U.S. Pat. Nos. 4,291,110; 4,338,387; 4,286,033; and, 4,291,110, the disclosures of these patents being incorporated herein in their entirety.

An optional adhesive layer 36 can be applied to the hole blocking layer. Any suitable adhesive layer may be utilized, such as a linear saturated copolyester reaction product of four diacids and ethylene glycol or a polyarylate. Any adhesive layer employed should be continuous and, preferably, have a dry thickness between about 200 μm and about 900 μm and, more preferably, between about 400 μm and about 700 μm. Any suitable solvent or solvent mixtures can be employed to form a coating solution of polyester. Any other suitable and conventional technique may be utilized to mix and thereafter apply the adhesive layer coating mixture of this invention to the charge blocking layer.

Any suitable charge generating layer 38 can be applied to the blocking layer 34 or adhesive layer 36, if such an adhesive layer 36 is employed, which can thereafter be overcoated with a contiguous charge transport layer 40. Appropriate photogenerating layer materials are known in the art, such as benzimidazole perylene compositions described, for example in U.S. Pat. No. 4,587,189, the entire disclosure thereof being incorporated herein by reference. More than one composition can be employed where a photoconductive layer enhances or reduces the properties of the charge generating layer. Other suitable photogenerating materials known in the art can also be used, if desired. Any suitable charge generating binder layer comprising photoconductive particles dispersed in a film forming binder can be used. Additionally, any suitable inactive resin materials can be employed in the photogenerating binder layer including those described, for example, in U.S. Pat. No. 3,121,006, the entire disclosure thereof being incorporated herein by reference.

The charge generating layer 38 containing photoconductive compositions and/or pigments and the resinous binder material generally ranges in thickness of from about 0.1 μm to about 5 μm, is preferably to have a thickness of from about 0.3 micrometer to about 3 μm. The charge generating layer thickness is related to binder content. Higher binder content compositions generally require thicker layers for charge or photogeneration. Thicknesses outside these ranges can be selected providing the objectives of the present disclosure are achieved.

The active charge transport layer 40 can comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. Thus, the active charge transport layer 40 can comprise any suitable transparent organic polymer or non-polymeric material capable of supporting the injection of photogenerated holes and electrons from the binder layer and allowing the transport of these holes or electrons through the organic layer to selectively discharge the surface charge.

The active charge transport layer 40 not only serves to transport holes or electrons, but also protects the photoconductive layer 38 from abrasion or chemical attack and therefore extends the operating life of the photoreceptor imaging member. The charge transport layer 40 should exhibit negligible, if any, discharge when exposed to a wavelength of light useful in xerography, for example, 4000 Å to 9000 Å. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the charge generation layer in the instant invention is a material which is an insulator to the extent that an electrostatic charge placed on the transport layer is not conducted in the absence of illumination.

The charge transport layer 40 forming mixture preferably comprises an aromatic amine compound. For example, suitable charge transport compounds that can be selected for the charge transport layer include aryl amines of the following formula

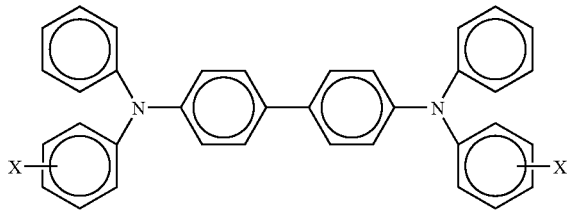

and wherein the thickness thereof is, for example, from about 5 microns to about 75 microns, or from about 10 microns to about 40 microns dispersed in a polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

In the charge transport layer, the charge transport agent(s) are dispersed, and may be dissolved, in an electrically insulating organic polymeric film forming binder. In general, any of the polymeric binders useful in the photoconductor element art can be used, including, for example, the unmodified binders described above for use in a charge generation layer. Examples of suitable binder materials selected for the transport layers include components, such as those described in U.S. Pat. No. 3,121,006, the disclosure of which is totally incorporated herein by reference. Specific examples of polymer binder materials include polycarbonates, polystyrene, acrylate polymers, vinyl polymers, cellulose polymers, polyesters, polysiloxanes, polyamides, polyurethanes and epoxies, and block, random or alternating copolymers thereof. A specific electrically inactive binder is comprised of polycarbonate resins having molecular weight of from about 20,000 to about 100,000, and in some embodiments, a molecular weight of from about 50,000 to about 200,000. However, polycarbonate and polystyrene are generally the preferred thermoplastic binder of choice for charge transport layer formulation to give best mechanical and electro-photographic imaging results. The preferably thermoplastic polycarbonate binder of interest is being either a poly(4,4'-isopropylidene diphenyl carbonate) or a poly(4,4'-diphenyl-1,1'-cyclohexane carbonate).

Typically, charge transport layers employed in one of the two electrically operative layers in the multi-layer imaging member web stock is comprised of from about 35 weight percent to about 45 weight percent of at least one charge transporting aromatic amine compound, and about 65 weight percent to about 55 weight percent by weight of a polymeric film forming resin in which the aromatic amine is soluble. The substituents should be free form electron withdrawing groups such as $NO_2$ groups, CN groups, and the like, and are typically dispersed in an inactive resin binder.

However, in the present disclosure, in order to provide a resulting imaging member with maximum photo-electrical performance enhancement, the charge transport layer 40 employed in the multi-layer imaging member web stock comprises from about 55 weight percent to about 70 weight percent of charge transport compound, such as a transporting aromatic amine compound, and about 45 weight percent to about 30 weight percent of a polymeric film forming resin. Optionally, the charge transport layer 40 comprises from about 55 weight percent to about 65 weight percent of a charge transport compound and from about 45 weight percent to about 35 weight percent of a polymeric film forming resin. The increased amounts of the charge transport compound in the charge transport layer provides effectual residual voltage reduction and/or improved photo discharge sensitivity.

In addition to a charge transport compound and a binder polymer, the charge transport layer may contain various optional additives, such as surfactants, levelers, plasticizers, and the like. On a 100 weight percent total solids basis, a charge transport layer can contain for example up to about 15 weight percent of such additives, although it may contain less than about 1 weight percent of such additives.

Coating of the charge transport layer composition over the charge generation layer can be accomplished using a solution coating technique such as knife coating, spray coating, spin coating, extrusion hopper coating, curtain coating, and the like. After coating, the charge transport layer composition is usually air dried.

The charge transport layer 40 should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer is preferably maintained from about 2.1 to 200:1 and in some instances as great as 400:1. Generally, the thickness of the transport layer 40 is between about 5 μm and about 100 μm, but thickness outside this range can also be used provided that there are no adverse effects. Typically, it has a Young's Modulus in the range of from about $2.5\times10^5$ psi to about $4.5\times10^5$ psi and with a thermal contraction coefficient of between about $6\times10^{-5}/°$ C. and about $8\times10^{-5}/°$ C. Furthermore, the charge transport layer also typically has a glass transition temperature Tg of a range of between about 65° C. and about 100° C.

Other layers, such as conventional ground strip layer 41 comprising, for example, conductive particles dispersed in a film forming binder may be applied to one edge of the photoreceptor in contact with the conductive layer 30, hole blocking layer, adhesive layer 36 or charge generating layer 38. The ground strip 41 can comprise any suitable film forming polymer binder and electrically conductive particles. Typical ground strip materials include those enumerated in U.S. Pat. No. 4,664,995. The ground strip layer 41 may have a thickness from about 7 μm to about 42 μm, and preferably from about 14 μm to about 23 μm. Optionally, an overcoat layer 42, if desired, can also be utilized to improve resistance and provide protection to imaging member surface abrasion.

The charge transport layer 40 typically exhibits a great thermal contraction mismatch compared to that of the substrate support 32. As a result, the prepared flexible electrophotographic imaging member exhibits spontaneous upward curling due to the result of larger dimensional contraction in the charge transport layer than the substrate support, especially as the imaging member cools down to room ambient after the heating/drying processes of the applied wet charge transport layer coating. An anti-curl back coating 33 can be applied to the back side of the substrate support 32 (which is the side opposite the side bearing the electrically active coating layers) to induce flatness. The anti-curl back coating 33 can comprise any suitable organic or inorganic film forming polymers that are electrically insulating or slightly semiconductive.

The anti-curl back coating 33 should have a thermal contraction coefficient of at least about $1\times10^{-5}$/° C. greater than that of the substrate support to be considered satisfactory. Typically, a substrate support has a thermal contraction coefficient of about $2\times10^{-5}$/° C. However, anti-curl back coating with a thermal contraction coefficient at least $+2\times10^{-5}$/° C. larger than that of the substrate support is preferred to produce an effective anti-curling result. The selection of a thermoplastic film forming polymer for the anti-curl back coating application has to be satisfying all the physical, mechanical, optical, and importantly, the thermal requirements above. Polymer materials which can meet these disclosure requirements include a variety of polymers known in the art. These polymers can be block, random or alternating copolymers. Furthermore, the selected film forming thermoplastic polymer for anti-curl back coating 33 application, if desired, can be of the same binder polymer used in the charge transport layer 40.

In addition, the electrophotographic imaging member, if desired, may optionally include an overcoating layer 42 to provide abrasion protection.

The fabricated multilayered, flexible electrophotographic imaging member web stock of FIG. 1 is then cut into rectangular sheets and converted into imaging member belts. The two opposite edges of each imaging member cut sheet are then brought together by overlapping and may be joined by any suitable method, including ultrasonic welding, gluing, taping, stapling, and pressure and heat fusing to form a continuous imaging member seamed belt, sleeve, or cylinder. From the viewpoint of considerations such as ease of belt fabrication, short operation cycle time, and mechanical strength of the fabricated joint, the ultrasonic welding process is more advantageous. The prepared flexible imaging belt can therefore be employed in any suitable and conventional electrophotographic imaging process that utilizes uniform charging prior to imagewise exposure to activating electromagnetic radiation.

As known from the principles of material mechanics, as the flexible imaging member seamed belt bends over the exterior surfaces of rollers of a belt module within an electrophotographic imaging machine during dynamic belt cycling function, the bottom surface of the anticurl back coating 33 of the flexible imaging member belt is compressed. In contrast, the top surface of charge transport layer 40 is stretched and placed under tension. This is attributable to the fact that the top and bottom surfaces move in a circular path about the circular roller. Since the top surface of charge transport layer 40 is at greater radial distance from the center of the circular roller than the bottom surface of anticurl back coating 33, the top surface must travel a greater distance than the bottom surface in the same time period. Therefore, the top surface must be under tension relative to a generally central portion of the flexible imaging member seamed belt (the portion of the flexible imaging member seamed belt generally extending along the center of gravity of the flexible imaging member seamed belt). Likewise, the bottom surface must be compressed relative to the generally central portion of the flexible imaging member seamed belt (the portion of the flexible imaging member seamed belt generally extending along the center of gravity of the flexible imaging member seamed belt). Consequently, the bending stress at the belt top surface will be tension stress, and the bending stress at the belt bottom surface will be compression stress as the imaging member belt flexes over each belt module support roller under a machine functioning condition.

From fracture mechanics, it is known that compression stresses, such as that at the bottom belt surface, rarely cause mechanical failure. Tension stresses, such as that induced at the top belt surface, however, are a more serious problem. The tension stress, under constant belt fatiguing condition, has been determined to promote the development of charge transport layer 40 cracking. The cracks, though initiated in the charge transport layer 40, continue to propagate to the generator layer 38, extend to the adhesive interface layer 36, cut through the blocking layer 34, and reach further to the conductive layer 30.

However, multiple layer belts with significant differences between layer thermal contraction coefficients exhibit spontaneous upward imaging member curling, due in part to the dimensional contraction mismatch between these layers. The imaging members thus can require an anti-curl back coating 33 applied to the back side of the substrate support layer 32 to balance the upward lifting force. This induces imaging member flatness prior to belt preparation, but yields belts with built-in internal strain. This internal strain can reach levels of, for example, approximately 0.28%, and is additive to the bending strain induced during imaging member belt fatigue under machine operational conditions. The cumulative effect of the internal strain plus the bending strain further promotes the early onset of dynamic fatigue charge transport layer cracking during imaging member belt cyclic machine function.

Moreover, bands of charge transport layer cracking caused by exposure to airborne chemical contaminants have also been found to form at imaging member belt segments parked/bent directly over each belt module support rollers over periods of machine idling and shut-off time. Additionally, it has also been found that the extent of charge transport layer cracking has become more pronounced as the content of the charge transport compound present in the charge transport layer is increased to effect the imaging member photo-electrical performance enhancement. Therefore, the photo-electrical function benefit realized by increasing the charge transport compound concentration is unfortunately negated by the early onset of this charge transport layer mechanical failure.

Both dynamic belt fatigue and chemical contaminant exposure induced crackings in the charge transport layer 40 of the imaging member seamed belt are serious mechanical failures that should be resolved and/or avoided. These cracks manifest as copy printout defects, shortening the usefulness and service life of the flexible imaging member seamed belts.

To resolve the charge transport layer cracking issue noted above for effecting the imaging member's functional life extension and for providing maximal photo-electrical performance outcome, imaging member web stock comprising high concentration of charge transport compound in the charge transport layer can then be subjected to a specific heat stress relief treatment process for effectual elimination of charge transport layer internal strain, as well as reducing the imaging member belt bending strain induced when the belt flexes/bends repeatedly over each belt module support roller during normal machine function. The disclosed process, according to the exemplary stress relief web stock heat treatment representation shown in FIG. 2, produces an effectual reduction in charge transport layer internal strain.

In this regard, an electrophotographic imaging member having a high concentration of a charge transport compound and having the material configuration shown in FIG. 1, is unwound from a supplied, roll-up web stock 10 and directed with the charge transport layer facing outwardly, for example under a one pound per linear inch tension and a web stock transport speed of about 13 feet/min, toward a one-inch concave outer diameter free-rotation processing treatment metal tube 306 having an arcuate Teflon® coated outer surface 310, and an annulus 309 with passing cool water to maintain the treatment tube temperature constant.

Figure 3:
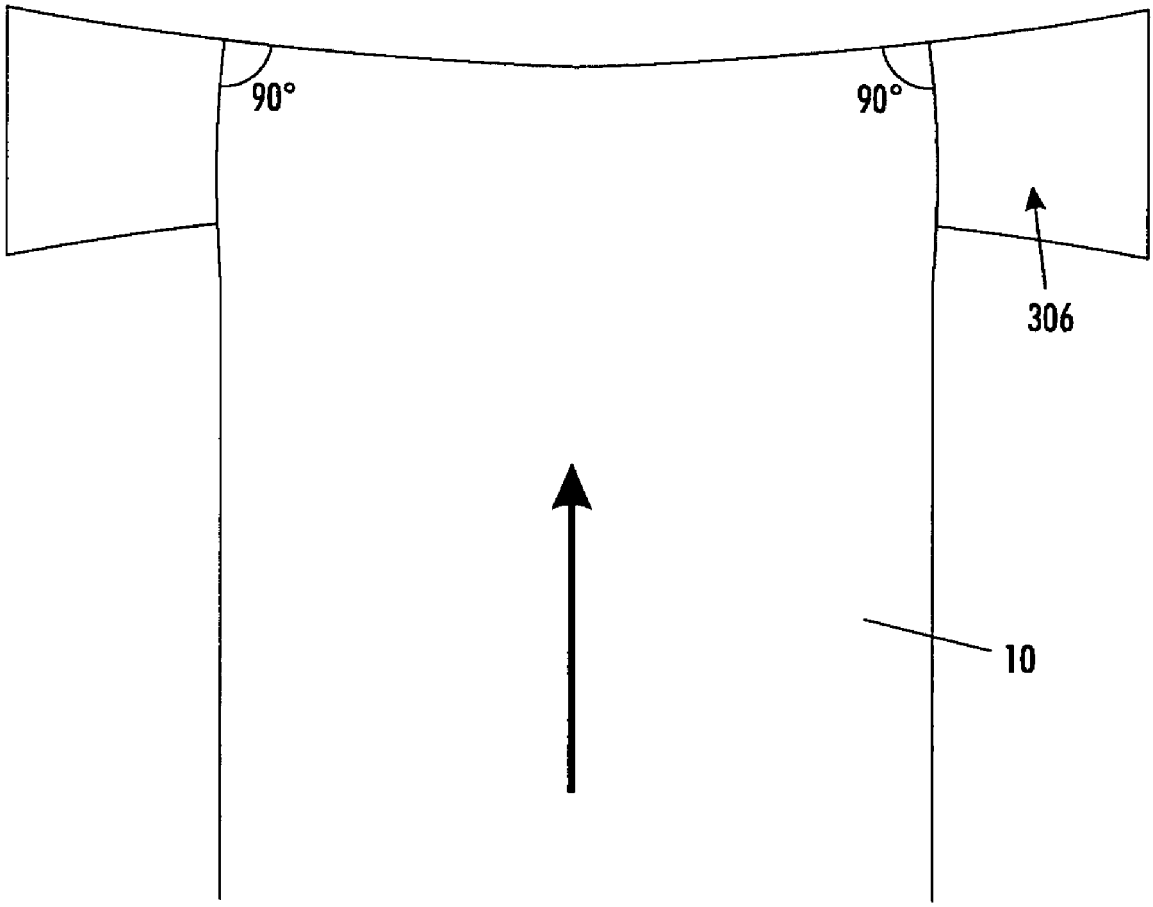
FIG. 3 illustrates the application of imaging member web stock to a specially designed heat treatment tube for producing web stock stress relief.

The processing treatment tube 306, having a concave outer circumferential dimension similar to an hour glass appearance, is shown in the pictorial representation in FIG. 3. The curvature of the outer concave arcuate circumferential surface can vary depending upon the specific processing parameters desired.

Figure 2:
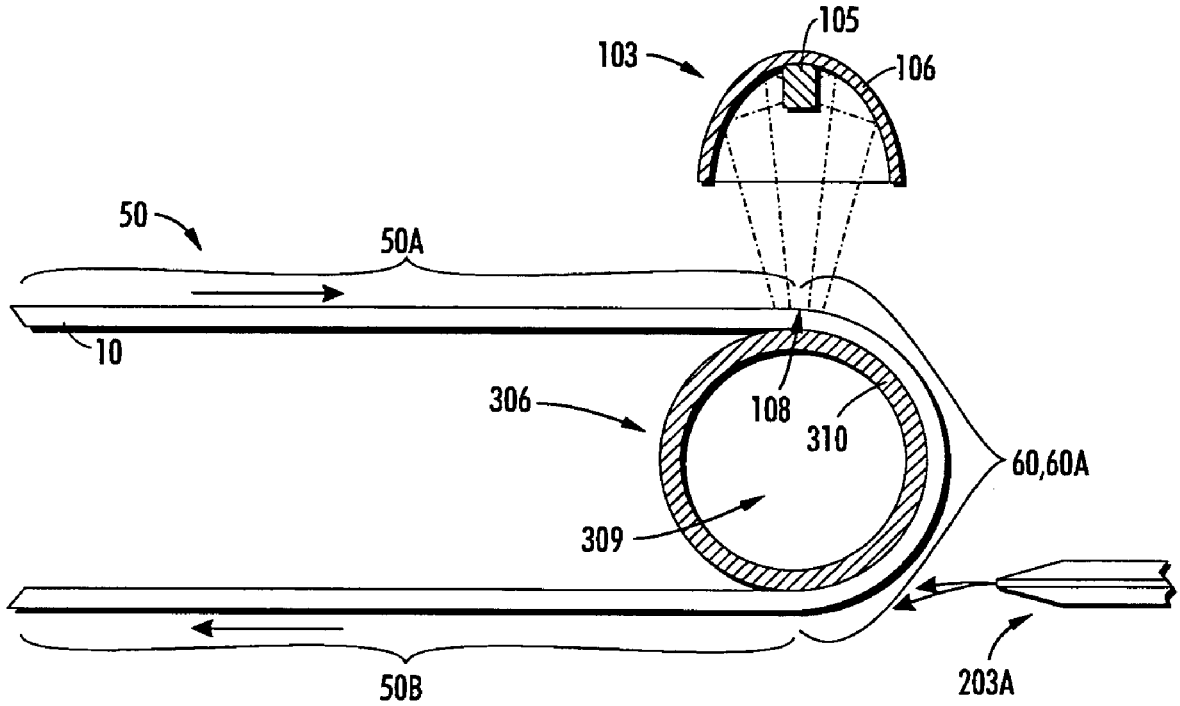
FIG. 2 shows a schematic representation of an embodiment of a heat treatment process employed to impart electrophotographic imaging member web stock charge transport layer stress relief.

According to the process illustrated in FIG. 2, imaging member web stock 10 of FIG. 1 under 25° C. ambient, is directed to make an entering contact at 12 O'clock with the tube 306 and conformed to the arcuate surface 310. A powerful IR emitting tungsten halogen quartz heating source 103, positioned directly above, brings upon an instant localized temperature elevation to the outer facing charge transport layer to about 10° C. above its glass transition temperature (Tg) to facilitate instant molecular chain motion of the polymer binder inside the layer and effect charge transport layer stress-relief while the segment of the web stock is under bending conformance contact over the arcuate surface 310.

The heat source 103 utilized in this process and processing apparatus is an integrated unit having a length sufficiently covering the whole width of the imaging member web stock. It consists of a hemi-ellipsoidal cross-section elongated reflector 106 and a halogen quartz tube 105 positioned at one focal point inside the reflector 106 such that all the IR radiation energy emitted form tube 105 is reflected and converged at the other focal point outside the reflector 106 to produce a 6 mm width focused heating line 108. The focused heating line 108 produces instant charge transport layer temperature elevation to beyond its Tg along the full width of the web stock. The full web stock width of the heated segment of charge transport layer after exposure to the focused heating line 108 begins to quickly cool down to below its Tg, through direct heat conduction to tube 306 and heat transfer to ambient air, as the web stock in continuous motion is transported away from heat source 103. A further and final charge transport layer cooling is assured by air impingement from an air knife 203A (directing a super-sonic, narrow stream of cool air onto the surface of the web stock) positioned at 4 O'clock to tube 306 prior to the web stock segment emerging from the curved contacting zone region to complete the imaging member web stock stress-release treatment process. In FIG. 2, the numerals 50, 50A and 50B are paths where the transporting electrophotographic imaging member 10 is freely suspended, while 60 and 60 Å are contact zones at which the segment of the imaging member is intimately riding over the treatment tube 306.

The material configuration of a typical electrophotographic imaging member web stock 10, as that shown in FIG. 1, used for carrying out the heat stress relief processing treatment of present disclosure, comprises a 3.5 mils (90 μm) flexible substrate support layer 32, about 100 Angstrom thickness of the titanium conductive layer 30, a 0.02 μm hole blocking layer 34, a 0.03 μm adhesive layer 36, a 0.08 μm photogenerating layer 38, a 29 μm charge transport layer 40, having a high concentration of a charge transport compound, a 18 μm conventional electrically conductive ground strip 41 coated along one edge of the imaging member web stock adjacent to the charge transport layer 40, and a 17 μm anti-curl back coating 33 to give a complete imaging member web stock 10 material package having reasonably good physical flexibility and flatness. With this materials composition of imaging member web stock 10, embodiment of processing heat treatment performed according to the illustrative representation of FIG. 2 is carried out using an one-inch concave heat treatment tube 306.

The concave heat treatment tube 306 used for heat stress relief treatment process of imaging member web stock 10, according to FIG. 2, is designed to have specific features of this disclosure to effect the creation of transversal web stock stretching tension for ripple/wrinkle defects prevention as particularly illustrated in FIG. 3. In embodiments, the diameter at the center of the treatment tube 306 ranges from about 0.5 inch to about 5 inches; but between about ¾ inch to about 1 inch is preferred to impart effectual web stock charge transport layer heat stress relief. In addition, the description of these embodiments also discloses that the treatment tube 306 has a concave or reversed crown feature of an hour glass appearance, with an outer diameter at both ends to be slightly greater than that at the center of the tube. Since the fundamentals of web handling dictate that a transporting imaging member web stock directed toward and making contact with a concave treatment tube 306 will make a 90° entry angle with the tube, as dictated by the Normal Entry Law, a transversal direction tension is spontaneously created to thereby stretch the imaging member outwardly toward the two web stock edges. The intensity of this cross web tension is created according to the radius of curvature differential of the concave tube 306. Therefore, the diameter at both outer ends of tube 306 shall be from about 0.002 inch and to about 0.1 inch larger than the diameter in the middle of the tube, to produce satisfactory transversal direction imaging member web stock stretching and to prevent ripple/wrinkle defects formation in the direction of the stress relief treatment processed web stock. To produce optimum impact on both web stock transversal stretching and heat stress relief, the diameter differential between the outer and center portion of tube 306 may then be designed to be from about 0.005 inch to about 0.02 inch.

Referring once more to the exemplary embodiment of the process and apparatus, according to FIG. 2 of the present disclosure, for treating a flexible multi-layer electrophotographic member web stock having a surface layer that exhibiting a glass transition temperature, the imaging member web stock 10 toward the concave treatment tube 306 having an arcuate outer surface 310, and an annular chamber 309. The chamber 309 of the treatment tube 306 can be accommodated with a passing air stream or with an alternatively coolant passing there through such as $CO_2$ snow, water, liquid nitrogen, alcohol, or any suitable cooling medium. The imaging member web stock 10, which initially may be at ambient temperature of about 25° C., makes an entering contact at for example before or about 12 O'clock and conforms to the arcuate surface 310 of component 306. In FIG. 2, the arcuate surface is driven by the moving member web stock 10, which causes the arcuate surface to rotate. Although the disclosed stress relief treatment process illustrated in FIG. 2 shows that imaging member web stock 10 cooling is effected by delivering a super sonic impinging air stream from air knife 203A, other effective cooling strategies that can be used, but are not limited to, include for example:

(1) the cooling air stream is first bubbled and passed through a water medium inside a container to bring along atomized liquid water mist to the air delivery knife 203A;

(2) the air impingement cooling device can be replaced with a low durometer (about 10 Shore A hardness) soft free rotating silicone cooling nip-roller; or (3) to enhance the cooling effect, the air knife 203A is provided with an impinging cooled air stream, liquid nitrogen, $CO_2$ snow, sub-cooled alcohol, low temperature cooling water, or another suitable coolant to accelerate the real time impact for quick imaging member web stock temperature lowering effect.

Figure 4:
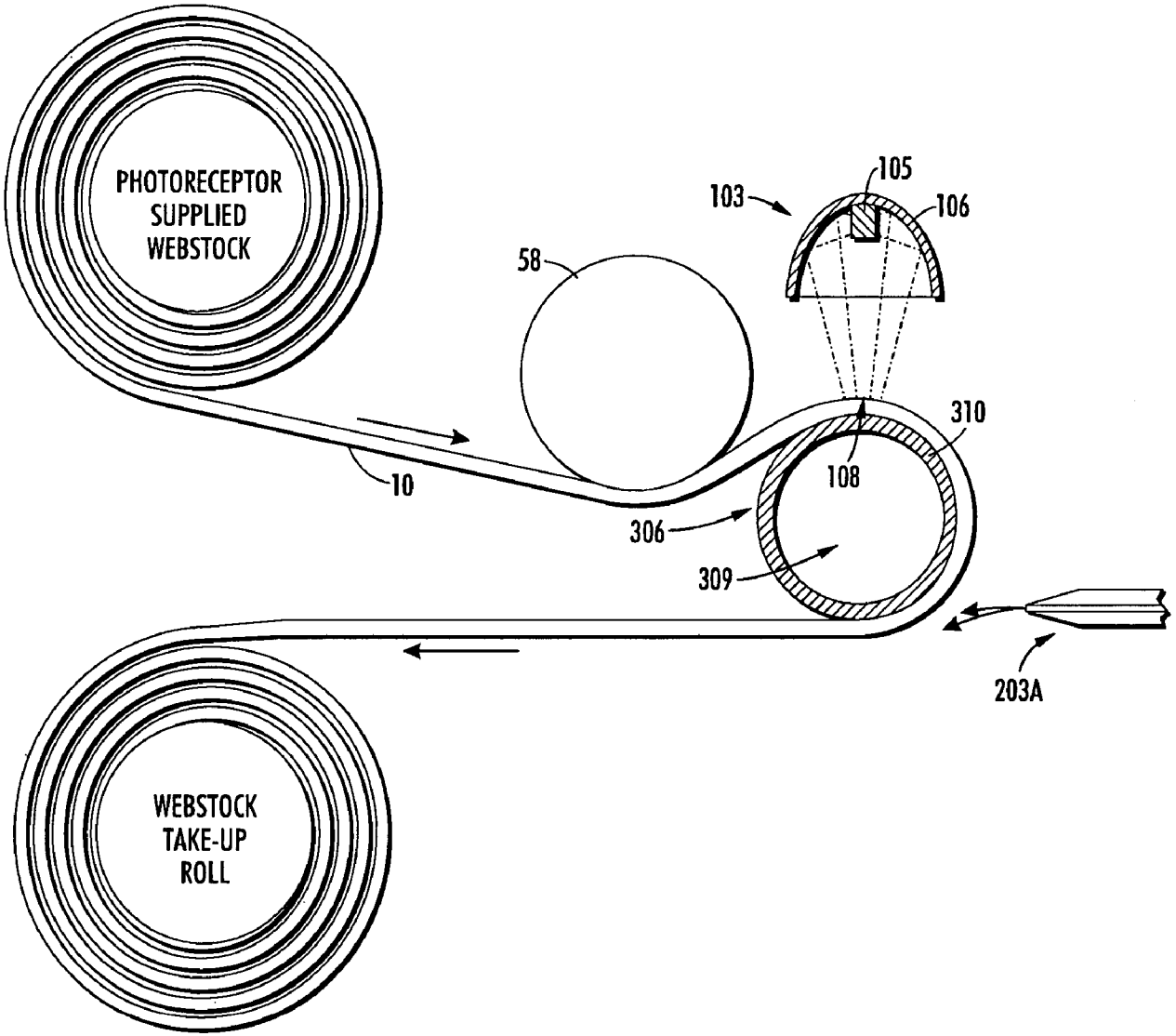
FIG. 4 shows a schematic representation of another innovative embodiment comprising improved processing features of present disclosure.

An embodiment of another heat treatment stress relief process that also overcomes the problem of ripple/wrinkle problem associated with the conventional art is shown in the schematic illustration of FIG. 4. This innovative process represents another alternative improvement provided through the addition of a refinement to the disclosure process of FIG. 2 to enhance efficiency. To achieve this purpose, the process in FIG. 2 is modified accordingly by incorporation of a selected roller 58 to support the imaging member web stock 10 in its transporting path. Roller 58 is added and inserted in a position between about 0.5 inch and about 7 inches in the nearby vicinity before the concave heat treatment tube 306; however, a distance of between about 1 inch and about 4 inches is preferred, in embodiments. The wrapped angle made by the imaging member web stock 10 around roller 58 is preferably in a range of from about 10° to about 300, although wrapped angles outside this range can be used, if desired. The selected roller 58 for this modified process is also a concave roller having the specific physical attribute same as that disclosed for tube 306 to effect creation of transversal web stock stretching toward the two edges prior to imaging member web stock 10 making contact with the heat treatment tube 306 to add web stock stretching effect for web stock ripple/wrinkle resolution. Although the roller 58 can be driven to rotate at a desired speed, such as near or equal to the member transport speed, it is preferred in embodiments that the roller 58 be idled (i.e., freely rotatable and not being actively driven other than by the passing member 10).

In yet another embodiment of present disclosure, the process also includes the roller 58 (not shown) be positioned after the heat treatment tube 306 and at a distance between about 0.5 inch and about 7 inches from the heat treatment tube 306, to fulfill the intended web stock ripple/wrinkle elimination and charge transport layer stress relief purposes. All of the details discussed above with respect to the roller 58 positioned before the heat treatment tube 306 apply equally to this embodiment, where the roller 58 is positioned after the heat treatment tube 306, and thus the details are not repeated here. The wrapped angle made by the imaging member web stock 10 around the roller 58 is again between about 10° and about 30°.

As described above, embodiments of present disclosure process can be executed by either placing the roller 58 at a position either just before or just after the heat treatment tube 306. However, in yet another embodiment, the innovative stress relief process of FIG. 4 is further modified to give another fine tuned process according to the illustration shown in FIG. 5. In this embodiment, two selected rollers (shown as rollers 58 and 59) are incorporated, one positioned before the heat treatment tube 306 while the other is positioned after the heat treatment tube 306, to yield maximum combination effect of imaging member web stock 10 stress relief and ripple/wrinkle elimination outcome. Although labeled in FIG. 5 as two different rollers 58, 59, the rollers may either be of the same or of different configuration designs. Thus, rollers 58, 59 used in FIG. 5 can both be concave/reversed crown rollers.

Figure 5:
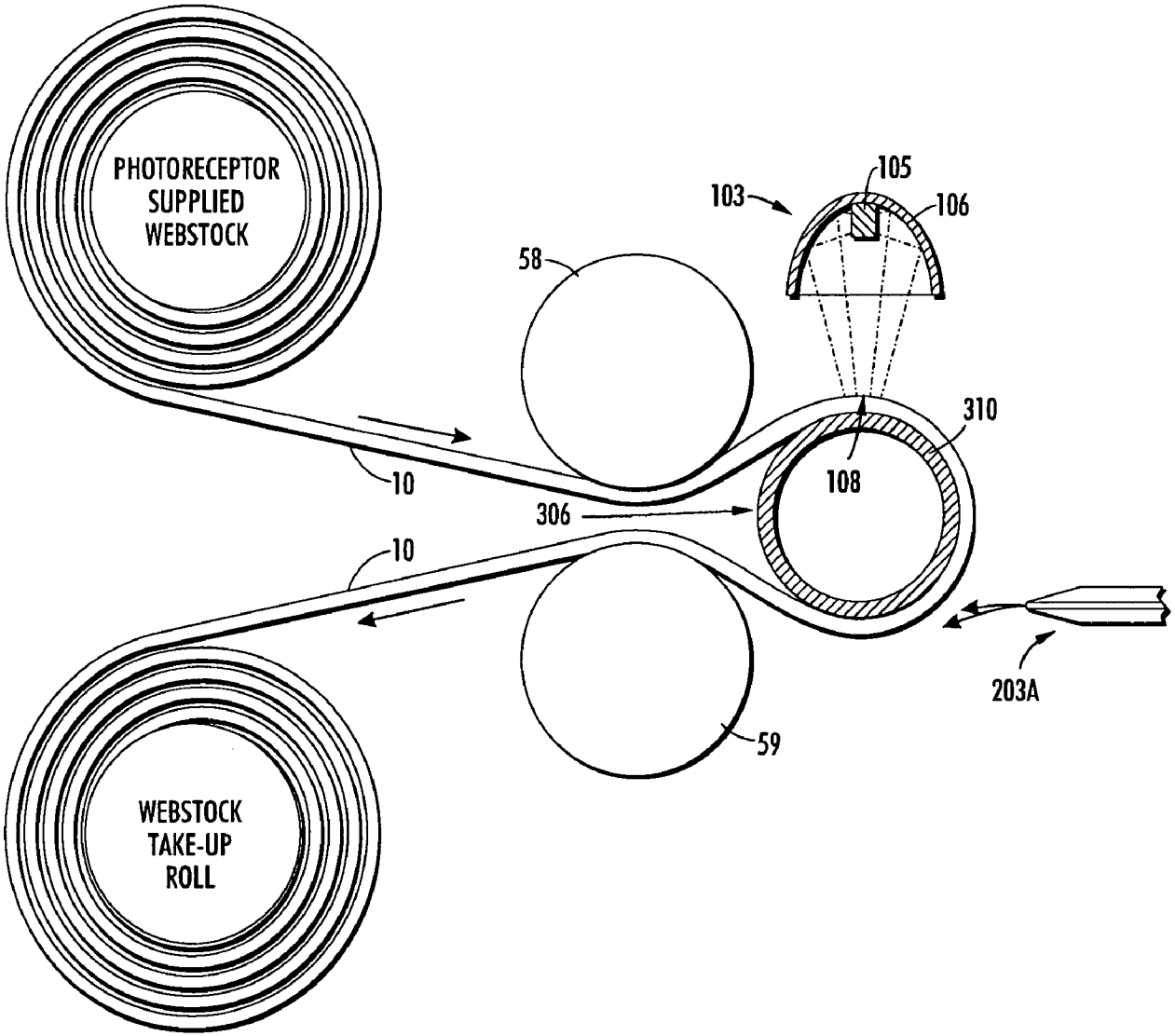
FIG. 5 shows a schematic representation of yet another innovative embodiment of the present disclosure.

Referring to FIG. 5, one of the rollers 58, 59 can be a concave/reversed crown roller, while the other one is a flexible spreader roller; otherwise, one or both of the rollers 58, 59 in FIG. 5 may be a roller of a chosen type to give best functional results.

In recapitulation of the general basis of the process disclosed herein: As the imaging member web stock 10 having a high concentration of a charge transport compound advances into the heating region of the member/tube 306 contacting path, a heating source 103 heats sequentially each portion of the surface layer to a temperature above the glass transition temperature while in the curved contact zone region. The heating occurs only in the heating region 108 of the member path. The phrase "heating region" refers to the area of the member path receiving heat from the heating source, such an area encompassing any part or all of the contact zone outside the cooling region and a portion of the pre-contact member path adjacent the contact zone.

In the depicted embodiments of FIGS. 2, 4, and 5, the heating source 103 is a high power infrared emitting tungsten halogen quartz lamp, positioned directly above the member to bring an instant localized temperature elevation in the surface layer. In embodiments, the heating source 103 is an integrated unit having a length covering the width of the member 10 and consisting of a hemi-ellipsoidal shaped cross-section elongated reflector 106 and a halogen quartz tube 105 positioned at a focal point inside the reflector 106, such that all the infrared radiant energy emitted from tube 105 is reflected and converges at the other focal point outside the reflector 106 to give a focused heating line at the heating region 108 to quickly bring about temperature elevation. The heating region provided by for example the focused heating line may range in width (that is, in the direction of member movement) from about 3 mm to about 1 cm, particularly from about 6 mm to about 12 mm, across the full width of the web stock 10. Alternatively, the heating source may be a laser such as a carbon dioxide laser. Any other suitable heating sources can also be used.

The heating raises each of the heated surface layer portions to a temperature ranging from about 5° C. to about 40° C. above its Tg, particularly from about 10° C. to about 20° C. above the Tg. The electrical power input to the heating source can be adjusted incrementally to produce the desired heat energy output. The temperature of the member can be monitored with an infrared camera.

The present method then cools sequentially each of the heated surface layer portions while in the contact zone such that the temperature of each of the heated surface layer portions falls to below the Tg prior to each of the heated surface layer portions exiting the curved contact zone region, thereby defining a cooling region. The phrase "cooling region" refers to the area of the member path after the heating region and before the post-contact member path, even including any place where the temperature of the surface layer portions has not yet fallen below the Tg. It is apparent that the "cooling region" excludes any place in the member path subjected to heating by the heating source.

After advancing into the cooling region, each of the heated surface layer portions after exposure to the heating source 103 will then quickly cool down when the member is transported away from the heat source 103, through for instance direct heat conduction away from the member to tube 306 as well as heat convection to the ambient air (due to movement of the member along the member path). A final cooling down can be achieved by an optional cooling system, such as a free rotating soft hydrophilic foam roll, an air impinging knife, or a coolant such as sub-cooled water, liquid nitrogen, alcohol and the like, passed through the annular chamber 309. Quick web stock cooling effect is achieved using an air impinging knife 203A and a coolant passed through the annular chamber 309.

Besides air, cooling by cooling system 203A may also be achieved by using impinging $CO_2$ snow, super-cooled nitrogen gas, liquid water, or alcohol and the like. Since impinging air, nitrogen, $CO_2$, liquid alcohol, or liquid water is a forced convection cooling process, the impinging cooling medium can quickly bring the temperature of the heated surface layer portions down to below the Tg. The temperature of the impinging cooling medium, if gaseous, can range for example from about −10° C. to about 20° C., particularly from about −5° C. to about 5° C. However, for a high heat conducting liquid such as water or alcohol, the temperature of the impinging liquid is for example from about 2° C. to about 25° C., particularly from about 5° C. to about 10° C.

In a modification, of the method and apparatus disclosed herein, the air impinging knife 203A can be replaced by a free rotating soft hydrophilic foam roll (saturated with a cooling liquid). Such a cooling roller is described in U.S. Patent Publication No. 2003/0067097, the entire disclosure of which is incorporated herein by reference. In this embodiment, the cooling roller makes compression contact with the member at a position spanning about 4 O'clock to about 6 O'clock to assure temperature lowering of the exiting surface layer portions to a temperature of at least about 20° C., particularly at least about 40° C., below the glass transition temperature to yield permanent stress or strain release. In this embodiment of the cooling system, the hydrophilic cooling roll can be a soft idling foam roll having a free rotating axial shaft and partially submersed, but totally saturated, in a cooling liquid bath (e.g., water, alcohol, and the like, or a mixture thereof) to provide effective cooling result. The temperature of the cooling liquid bath ranges for example from about 0 to about 25° C., particularly from about 5 to about 10° C.

In addition, as described above, the annular 309 of the treatment tube 306 can include air at ambient temperatures; or a coolant such as sub-cooled water, liquid nitrogen, alcohol and the like, can be passed through the annular chamber 309. The temperature of the water and/or alcohol coolant passing through the chamber ranges, for example, from about 0 to about 25° C., particularly from about 5 to about 10° C.

In embodiments, to enhance the stress relief effect of the present method, the member web stock 10 can be transported through the member path at a speed described herein such that the heat extraction from the member by the cooling mechanism is effective to bring down the temperature of each of the surface layer portions to significantly lower than the Tg prior to each of the surface layer portions exiting the curved contact zone region.

Embodiments of present disclosure provide a concave treatment tube design having specific refinement feature, utilized in each of the processes according to FIGS. 2, 4, and 5. Utilization of this treatment tube design produces an imaging member web stock 10 can be produced with effectual stress release in the charge transport layer. This is produced by eliminating tension strain ranging for example from about 0.9% to about 0.1%, particularly from about 0.6% to about 0.2%, for mechanical function life extension. However, stress release for members having a tension strain outside these ranges can also be obtained, if desired. In addition, each of these processes is also equally capable to provide effectual resolution/elimination of the ripple/wrinkle problem.

The speed of the imaging member web stock 10 to effect satisfactory heat stress relief treatment outcome is, for example, from about 5 ft/minute to about 40 ft/minute, particularly from about 10 ft/minute to about 20 ft/minute. However, a speed of 13 ft/minute is preferred.

Accordingly, each of the present processes disclosed in the preceding paragraphs significantly reduces the build-up of internal tension strain within the charge transport, thereby providing any or all of the following benefits: (1) elimination or reduction of edge curling; (2) reduction of the propensity of charge transport layer cracking, thereby producing life extension; (3) provides the option of minimizing the use of an anti-curl backing layer for an imaging member; and (4) prevention of web stock ripples/wrinkles defects.

Although the charge transport layer 40 of the imaging member web stock shown in FIG. 1 may theoretically comprise from about 35 weight percent to about 85 weight percent of a charge transport compound and a polymeric film forming resin, nonetheless it has been determined, under normal electrophotographic imaging conditions, that a charge transport compound content of from about 55 weight percent or more produces the best photoelectrical performance such as, for example, enhanced photosensitivity, lower residual potential, and reduced background voltage. Unfortunately, embodiments of flexible imaging members having a charge transport compound in amounts above 50 weight percent in the charge transport layer to yield the photoelectrical benefits are found to be negated by the creation of a brittle charge transport layer. In other words, while increasing the charge transport compound content does achieve significant photoelectrical function improvement, it is offset by causing the formation of en-brittleness to thereby shorten its mechanical service life. Embodiments of the present disclosure have however identified that imaging members prepared to have a charge transport layer comprising from about 55 weight percent or more, including from about 55 weight percent to about 70 weight percent, such as from about 55 weight percent to about 65 weight percent charge transport compound, do provide optimum photo-electrical properties and mechanical function life, after being treated by the web stock heat stress relieving treatment process noted above.

Processes of imaging, especially xerographic imaging and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

The present disclosure will be further illustrated by the following non-limiting examples; it being understood that these examples are intended to be illustrative only and that the development is not intended to be limited to the materials, conditions, process parameters and the like recited herein. All proportions are by weight unless otherwise indicated.

EXAMPLES

Imaging Member Web Stock Preparation (I) Eight flexible electrophotographic imaging member web stocks, in reference to the illustration in FIG. 1, were prepared by providing to each web stock a 0.01 μm thick titanium layer 30 coated onto a flexible biaxially oriented polynaphthalate substrate support layer 32 (Kadalex®, available from ICI Americas, Inc.) having a thermal contraction coefficient of about 1.8×10−5/° C., a glass transition temperature Tg of 130° C., and a thickness of 3.5 mils or 88.7 μm, and applying thereto, by a gravure coating process, a solution containing 10 grams gamma aminopropyltriethoxy silane, 10.1 grams distilled water, 3 grams acetic acid, 684.8 grams of 200 proof denatured alcohol and 200 grams heptane. This layer was then dried at 125° C. in a forced air oven. The resulting blocking layer 34 had an average dry thickness of 0.05 μm measured with an ellipsometer.

An adhesive interface layer was then extrusion coated by applying to the blocking layer, a wet coating containing 0.16 percent by weight based on the total weight of the solution of ardel polyarylate adhesive (available from Toyota-Hsushu, Inc.) in an 8:1:1 weight ratio mixture of tetrahydrofuran/monochloro-benzene/methylene chloride solvent mixture. The resulting adhesive interface layer 36, after passing through an oven, had a dry thickness of 0.02 μm.

The adhesive interface layer 36 was thereafter coated with a photogenerating layer 38. The photogenerating layer dispersion was prepared by introducing 0.45 grams of IUPILON 200® poly(4,4'-diphenyl)-1,1'-cyclohexane carbonate, available from Mitsubishi Gas Chemical Corp and 50 mL of tetrahydrofuran into a glass bottle. To this solution is added 2.4 grams of hydroxygailium phthalocyanine (HOGaPC) and 300 grams of ⅛ inch (3.2 mm) diameter stainless steel shot. This mixture was then placed on a ball mill for 20 to 24 hours. Subsequently, 2.25 grams of poly(4,4'-diphenyl)-1,1'-cyclohexane carbonate was dissolved in 46.1 grams of tetrahydrofuran, then added to the hydrogallium phthalocyanine slurry. The slurry was then placed on a shaker for 10 minutes. The resulting slurry was, thereafter, extrusion coated onto the adhesive interface 36 by extrusion application process to form a layer having a wet thickness of 0.25 mL. However, a strip about 10 mm wide along one edge of the substrate web bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in a forced air oven to form a dry thickness photogenerating layer 38 having a thickness of 0.4 μm layer.

Each of the eight coated imaging member webs was simultaneously co-extrusion overcoated with a charge transport layer 40 and a ground strip layer 41. Each charge transport layer was prepared by introducing into an amber glass bottle a charge transport compound of N,N'-diphenyl-N,N'-bis(3-methylphenyl)-1,1'-biphenyl-4,4'-diamine, m-TBD, and Makrolon 5705®, a polycarbonate resin having a weight average molecular weight of about 120,000 commercially available from Farbensabricken Bayer A.G. Each of resulting mixture was dissolved to give a 15 percent by weight solids in 85 percent by weight methylene chloride. Each solution was then applied over the photogenerator layer 38 to form a coating which, upon drying, produced a charge transport layer 40 thickness of 29 μm and a thermal contraction coefficient of $6.5\times10^{-5}$/° C.

The approximately 10 mm wide strip of the adhesive layer 36 left uncoated by the photogenerator layer 38 was coated with a ground strip layer during a co-coating process. This ground strip layer 41, after drying at 125° C. in an oven and eventual cooling to room ambient, had a dried thickness of about 19 μm. This ground strip was electrically grounded, by conventional means such as a carbon brush contact means during conventional xerographic imaging process. The electrophotographic imaging member web stock, at this point if unrestrained, would spontaneously curl upwardly into a tube due to the thermal contraction mismatch between the charge transport layer 40 and the substrate support layer 32, resulting in greater charge transport layer 40 dimensional shrinkage than the substrate support layer 32 which thereby caused substantial internal stress built-in in the charge transport layer 40.

An anti-curl back coating solution was then prepared by combining 8.82 grams of polycarbonate resin (Makrolon 5705®, available from Bayer AG), 0.72 gram of polyester resin (Vitel PE-200®, available from Goodyear Tire and Rubber Company) and 90.1 grams of methylene chloride in a glass container to form a coating solution containing 8.9 percent by weight solids. The container was covered tightly and placed on a roll mill for about 24 hours until the polycarbonate and polyester were dissolved in the methylene chloride to form the anti-curl back coating solution. The anti-curl back coating solution was then applied to the rear surface of each of the eight the substrate support layers 32 (the side opposite the photosensitive) of the imaging member web stocks and dried at 125° C. to produce a dried anti-curl back coating 33 thickness of about 17.5 μm. Each of the resulting eight electrophotographic imaging member web stocks had the desired flatness and with the same material structure as that schematically illustrated in FIG. 1 (but without an overcoat layer 42) is a complete imaging member full device. The eight charge transport layers formulated comprised 30, 35, 40, 45, 50, 60, 70, and 80 weight percent m-TBD charge transport compound, respectively, based on the total weight of the dried charge transport layer.

(II) In similar manner, eight flexible electrophotographic imaging member web stocks were prepared by following the exact same procedures and also using the same materials as those described in (I), but with the exception that the hydrogallium phthalocyanine (HOGaPc) in each charge generating layer (CGL) 38 of these imaging members was replaced with benzimidazole perylene (BZP). Again, the eight charge transport layers formulated comprised 30, 35, 40, 45, 50, 60, 70, and 80 weight percent m-TBD charge transport compound, respectively, based on the total weight of the dried charge transport layer Stress Relief Treatment Processing The two types of the above flexible electrophotographic imaging member web stocks, one type prepared to comprise hydrogallium phthalocyanine while the other prepared to comprise benzimidazole perylene in each photogenerating layer 38, were each cut to give two separate groups of web stocks. One group was kept to serve as control whereas the other group was processed through charge transport layer (CTL) heat stress relief treatment according to the pictorial representation of FIG. 2. This heat stress relief process was intended to reduce or eliminate the internal stress in charge transport layer (CTL) 40, through continuous web stock heat treatment processing.

In essence, the imaging member web stock is unwound from a roll-up imaging member supply roll and is directed (with the CTL 40 facing outwardly, under a one pound per linear inch width web tension, and a web stock transport speed of 13 feet per minute) toward a one-inch outer diameter free rotation processing treatment concave tube 306 having an arcuate outer surface 310, a wall thickness, an annulus 309, and diameter differential of 0.02 inch. The imaging member web stock, under 25° C. ambient temperature, makes an entering contact at 12 O'clock with the tube 306 and conformed to the arcuate surface 310. A powerful infrared emitting tungsten halogen quartz heating source 103, positioned directly above, brings upon an instant localized temperature elevation to the CTL 40 to 10° C. above its glass transition temperature (Tg) to facilitate molecular motion and effect instant stress relief from the CTL 40 while the segment of the imaging member web stock is in bending conformance contact over the arcuate surface 310. The heating source 103 is an integrated unit having a length sufficiently covering the whole width of the imaging member segment; it consists of a hemi-ellipsoidal cross-section elongated reflector 106 and a halogen quartz tube 105 positioned at one focal point inside the reflector 106 such that all the infrared radiant energy emitted from heating tube 105 is reflected and converged at the other focal point outside the reflector 106 to give a 6 mm width focused heating line 108 that effects instant CTL 40 temperature elevation beyond its Tg.

The heated segment of CTL 40 after exposure to the heating line 108 began to cool down, through direct heat conduction to tube 306 and heat transfer to ambient air, as the imaging member web stock in constant motion was transported away from heat source 103. A further and final CTL 40 cooling was assured by air an impingement from an air knife positioned at 4 O'clock to the tube 306 prior to imaging member web stock segment emerging from tube 306 to complete the treatment process.

The resulted in the formation of a roll of imaging member web stock material that was subjected through the heat stress relief processing treatment according to the disclosure of FIG. 2.

Electrical And Mechanical Cyclic Testings

A 4"×4" sample was cut from each of the stress relief processed electrophotographic imaging member web stocks disclosed above and determined for its photo-electrical properties using a lab scanner. The results obtained, showing the impact of charge transport compound (m-TBD) content in the charge transport layer (CTL) and the benzimidazole (BZP) vs hydroxylgallium phthalocyanine (HOGaPC) in the charge generating layer (CGL) on photo-electrical performance of the imaging member, are presented in Table 1 below:

TABLE 1

| % m-TBD in CTL | RESIDUAL BZP CGL | VOLTAGE HoGaPC CGL |
|---|---|---|
| 30 | 125 | 137 |
| 35 | 70 | 75 |
| 40 | 45 | 48 |
| 45 | 30 | 35 |
| 50 | 20 | 20 |
| 60 | 10 | 11 |
| 70 | 10 | 10 |
| 80 | 10 | 10 |

Electrical testing disclosed that the photo-electrical properties, such as charge acceptance, field potential, photo discharge characteristic, sensitivity, dark decay, back ground potential, and with very pronounced effect on residual voltage (as evident in the data listed in Table 1 above), were significantly improved as the m-TBD loading level in the charge transport layer was increased for both BZP and HOGaPC types of imaging members. In addition, it was also confirmed that subjecting the imaging members through heat stress relief processing treatment to reduce/minimize or eliminate both the internal and the bending strains from the charge transport layer did not alter the photo-electrical characteristics and performance of each resulting imaging member as compared to the respective non treated imaging member control counterpart.

The eight untreated HOGaPC CGL imaging members containing 30, 35, 40, 45, 50, 60, 70, and 80 weight percent m-TBD variances charge transport layer (CTL) were then each subjected to mechanical tensile CTL cracking test (using 2-inch width and 5-inch length test sample). The test was carried out by stretching a test sample, at a successive incremental increase of 0.5% strain interval, until reaching the point that tensile induced CTL cracking had become evident. The strain at which the CTL cracking of a test sample was notable, under 100× magnification, is recorded as the CTL cracking strain and tabulated in Table 2 below:

TABLE 2

| % m-TBD in CTL | CTL CRACKING STRAIN, % HOGaPC CGL |
|---|---|
| 30 | 11.5 |
| 40 | 7.5 |
| 50 | 3.5 |
| 60 | 2.0 |
| 70 | 1.5 |
| 80 | brittle CTL for accurate testing |

The experimental study had demonstrated that increasing the m-TBD loading in the CTL was the key to lowering the residual voltage (Vr) and effectively improving other photo-electrical properties for all these untreated imaging members. However, nonetheless the benefit of this electrical improvement was again found to be counteracted/negated by serious mechanical property degradation of converting the CTL, from being ductile, into a brittle coating layer as the m-TBD loading level which was increased.

To assess the effect of heat stress relief processing treatment on imaging member mechanical life enhancement with respect to m-TBD loading level variances in the CTL, both the treated imaging members and the untreated controls were individually cut to give 1-inch width and 12-inch length test samples for dynamic fatigue CTL cracking determination. Testing was conducted by means of using a dynamic cycling surrogate device, in which each test sample was flexed over idler rollers to represent machine imaging member belt machine functioning condition. In essence, one end of the sample was clamped to a stationary post while the other end of the sample was looped upwardly over 3 equally spaced horizontal idler rollers and then downwardly to form a generally inverted "U" shaped path with the free end of the sample attached to a one pound weight to yield a 1 lb./inch sample width tension which was similar to the applied belt tension used in a machine. The surface of the sample having the CTL was faced upwardly such that it was subjected to the maximum induce bending strain as the sample was flexed over each of the idler rollers. Each of the 3 idler rollers selected for this dynamic fatigue testing had a ½ inch diameter to accelerate the outcome of flexing induced CTL cracking failure. The surrogate testing device was designed so that each idler roller was attached at each end to an adjacent vertical surface of a pair of aluminum disks that were rotatable, by means of an electrically power motor, about a shaft connecting the centers of the disks. The three idler rollers were parallel to and equidistant from each other. These idler rollers were also equidistant to the shaft connecting to centers of the disks.

Although the disks were rotated about the shaft, each idler roller was secured to the disks and freely rotated around each individual axis. Therefore, as the disks rotated about the shaft, two idler rollers were maintained at all times in contact with the back surface of the test sample. The axis of each idler roller was positioned about 4 cm from the shaft. The direction of movement of the idler rollers along the back surface of the test sample was away from the weighted end of the sample and toward the end that was clamped to the stationary post. Since there are three idler rollers in the test device, each complete rotation of the disks was equivalent to three bending flexes. The rotation of the spinning disks was adjusted to provide the equivalent of 11.3 inches/second of tangential speed. The appearance of dynamic fatigue induced cracking in the CTL was determined by sample examination at intervals of specific rotational cycles, using a reflection optical microscope under 100× magnification. The testing results obtained for the treated imaging member samples and the untreated control ones are given in the following Table 3:

TABLE 3

| % m-TBD in CTL | FATIGUE FLEXES OF CTL CRACKING HOGaPC CGL AMAT |
|---|---|
| 30 | 850,000 (115,000) |
| 40 | 160,000 (68,000) |
| 50 | 100,000 (40,000) |
| 60 | 50,000 (15,000) |
| 70 | 15,000 (5,000) |
| 80 | too brittle for accurate testing |

Note:

Values in parentheses are for those corresponding to the control untreated imaging member counterparts. Since the data in the table are fatigue cycling results over half inch diameter rollers (a highly stressful bending strain condition), these data should be multiplied by a factor of 3 to give projected fatigue CTL cracking life for imaging member belt used in electrophotographic imaging machine utilizing belt module support rollers of 19 mm in diameter.

The results shown in above Table 3 lead to the conclusion that heat stress relief processing treatment is highly effectual to impart the imaging member with mechanical function enhancement at m-TBD level of less than 70 weight percent. Very importantly, combination of data shown in Tables 1, 2, and 3 do also provide a particular insight to identify an optimum condition indicating that imaging members prepared to have CTL comprising m-TBD level between about 55 weight percent and about 65 weight percent in coupled with heat stress relief processing treatment should produce imaging member belts having good photo-electrical function and effectual CTL cracking life extension to meet the all current electrophotographic imaging machines need employing belt module support rollers exceeding 19 mm in diameter.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A rectangular stress relieved, flexible imaging member comprising:

a substrate;

an anti-curl back coating;

an optional hole blocking layer;

a charge generating layer;

a charge transport layer;

wherein said charge transport layer comprises from about 55 weight percent or more of an aromatic amine charge transport compound and a polymeric film forming resin; and, wherein the rectangular flexible imaging member is subjected to a heat treatment process to produce a stress relieved, flexible imaging member, the process comprising:

providing the rectangular flexible imaging member at ambient temperature;

heating the charge transport layer to a temperature from about 5° C. to about 40° C. above the Tg of the charge transport layer;

stretching the flexible imaging member with its heated charge transport layer over a concave tube; and cooling the charge transport layer to below its Tg;

wherein the concave tube has a center diameter and an end diameter, the center diameter being from about 0.5 inches to about 5 inches; and the end diameter being from about 0.002 inches to about 0.1 inches larger than the center diameter, so that the flexible imaging member is stretched in a belt direction and in a transverse direction.

2. An imaging member in accordance with claim 1, wherein the charge transport layer comprises aryl amines, and which aryl amines are of the formula

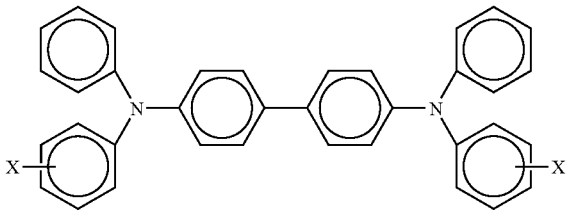

wherein X is selected from the group consisting of alkyl and halogen.

3. An imaging member in accordance with claim 2, wherein alkyl contains from about 1 to about 10 carbon atoms, wherein halogen is chloride, and wherein there is further included a resinous binder selected from the group consisting of polycarbonates and polystyrenes.

4. An imaging member in accordance with claim 2, wherein the aryl amine is N,N'-diphenyl-N,N-bis(3-methyl phenyl)-1,1'-biphenyl-4,4'-diamine.

5. An imaging member in accordance with claim 1, wherein the charge transport layer comprises from about 55 weight percent to about 70 weight percent of an aromatic amine charge transport compound and from about 45 weight percent to about 30 weight percent of a polymeric film forming resin.

6. An imaging member in accordance with claim 1, wherein the charge transport layer comprises from about 55 weight percent to about 65 weight percent of an aromatic amine charge transport compound and from about 45 weight percent to about 35 weight percent of a polymeric film forming resin.

7. An imaging member in accordance with claim 1, wherein the charge transport layer comprises a film forming thermoplastic polycarbonate binder of poly(4,4'-isopropylidene diphenyl carbonate).

8. An imaging member in accordance with claim 1, wherein the charge transport layer comprises a film forming thermoplastic polycarbonate binder of poly(4,4'-diphenyl-1,1'-cyclohexane carbonate).

* * * * *